US008344628B2

(12) United States Patent
Kishimoto

(10) Patent No.: US 8,344,628 B2
(45) Date of Patent: Jan. 1, 2013

(54) DIMMING ELECTRONIC BALLAST WITH LAMP END OF LIFE DETECTION

(75) Inventor: Naokage Kishimoto, Hirakata (JP)

(73) Assignee: Panasonic Corporation, Osaka (JP)

( * ) Notice: Subject to any disclaimer, the term of this patent is extended or adjusted under 35 U.S.C. 154(b) by 508 days.

(21) Appl. No.: 12/558,346

(22) Filed: Sep. 11, 2009

(65) Prior Publication Data

US 2010/0096995 A1 Apr. 22, 2010

(30) Foreign Application Priority Data

Sep. 12, 2008 (JP) ..... 2008-234989

(51) Int. Cl.
*H05B 37/00* (2006.01)
*H05B 41/00* (2006.01)

(52) U.S. Cl. ..... 315/119; 315/127; 315/224; 315/225; 315/308

(58) Field of Classification Search ..... None
See application file for complete search history.

(56) References Cited

U.S. PATENT DOCUMENTS 6,147,463 A * 11/2000 Luger et al. ..... 315/307
6,337,544 B1 * 1/2002 Wang et al. ..... 315/291

FOREIGN PATENT DOCUMENTS

JP 2005216553 8/2005

* cited by examiner

*Primary Examiner* — Anh Tran
(74) *Attorney, Agent, or Firm* — Waddey & Patterson, P.C.; Mark J. Patterson; Mark A. Pitchford

(57) ABSTRACT

A electronic ballast according includes a DC power source circuit for generating a DC voltage from an AC power source, a pair of switching elements, an LC series resonance circuit, an inverter circuit for converting the DC voltage into a high frequency voltage to supply to a fluorescent lamp FL, and means such as a current transformer for detecting a current flowing into the fluorescent lamp FL, wherein oscillation of the inverter circuit is stopped when a value of a current flowing into the fluorescent lamp exceeds a predetermined value.

12 Claims, 6 Drawing Sheets

DIMMING ELECTRONIC BALLAST WITH LAMP END OF LIFE DETECTION

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: Japanese Patent Application No. JP2008-234989, filed Sep. 12, 2008.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates to electronic ballasts for realizing high frequency lighting of a fluorescent lamp and a lighting fixture using the same.

Conventional electronic ballasts for fluorescent lamps includes those disclosed in Japanese Patent Publication No. 2005-216553 in which the ballast continuously varies a light output of a fluorescent lamp by operation of a variable resistor for dimming control operation. In such an electronic ballast according to this conventional example, a high frequency output in a inverter circuit is determined depending on a dimming control level determined by a variable resistor for dimming control operation, which is connected to a dimming circuit. A user can obtain a desired light output in a range from a dimming control upper limit to a dimming control lower limit by freely operating the variable resistor for dimming control operation.

Release of electrons from a cathode on one side of a fluorescent lamp is diminished at the end of life stage of the fluorescent lamp and lamp rectification occurs as shown in FIG. 7. At this stage, a voltage drop is increased in the cathode where electrons are hard to be released and power loss is increased in the vicinity of the cathode. As a result, excessive heat is generated in the vicinity of the cathode and a voltage stress applied to a switching element in a inverter circuit is increased, thereby impairing the reliability of the ballast and a lighting fixture with a electronic ballast mounted thereon.

A conventional ballast circuit is shown in FIG. 6 includes means adapted to detect a voltage of a fluorescent lamp FL, wherein an inverter control circuit 3 detects an increase in a voltage applied to the fluorescent lamp FL when a rectification phenomenon occurs at a lamp end of life. This is followed by disabling oscillation of switching elements Q1 and Q2 arranged in inverter circuit 2. However, in this conventional example, it is impossible to determine the difference between an increase in a voltage applied to the fluorescent lamp FL in a dimming control and an increase in a voltage applied to the fluorescent lamp FL at a lamp end of life.

The present invention was achieved by taking the above problems into consideration, having an object to provide a electronic ballast with high reliability by detecting a lamp end of life condition with high accuracy even in the vicinity of a lower limit of a dimming control, without affecting the dimming control level of a fluorescent lamp, and thereby controlling the electronic ballast in a protection mode.

BRIEF SUMMARY OF THE INVENTION

An electronic ballast according to a first aspect of the present is provided to solve the above problems, includes a DC power source circuit (i.e. rectifying smoothing circuit) for generating a DC voltage from an AC power source, a pair of switching elements, an LC series resonance circuit (including an inductor and a capacitor), an inverter circuit for converting the DC voltage into a high frequency voltage to supply to a fluorescent lamp FL, and means such as a current transformer for detecting a current flowing into the fluorescent lamp FL, wherein oscillation of the inverter circuit is stopped when a value of a current flowing into the fluorescent lamp exceeds a predetermined value A second aspect of the present invention is based on the first aspect of the present invention, and further includes a preheating circuit for supplying a preheating current from an output of a secondary winding of a transformer to a cathode of the fluorescent lamp, and means adapted to detect a current flowing into the fluorescent lamp FL by a voltage between both ends of an impedance element such as a resistor which is connected between the resonance capacitor in the LC series resonance circuit and one end of the cathode of the fluorescent lamp 4.

A third aspect of the present invention is based on the first or second aspect of the present invention, having means adapted to recognize a current flowing into the fluorescent lamp as a digital signal by using a microcontroller wherein a lamp end of life condition is determined by software of the microcontroller 8*e*.

A fourth aspect of the present invention is based on the first to third aspects of the present invention, wherein a value of a current flowing into the fluorescent lamp is suppressed to a predetermined value or less by controlling an oscillation frequency of the inverter circuit when a value of a current flowing into the fluorescent lamp exceeds a predetermined value.

A fifth aspect of the present invention is based on the first to fourth aspects of the present invention, wherein the means adapted to detect a current flowing into the fluorescent lamp detects a peak value of a current flowing into the fluorescent lamp.

A sixth aspect of the present is a lighting fixture using the electronic ballast according to any one of the first to fifth aspects.

According to the first aspect of the present invention, an electronic ballast with high reliability can be provided by detecting a lamp end of life stage with high accuracy even in the vicinity of a lower limit of a dimming control, independently of a dimming control level, and controlling the electronic ballast in a protection mode.

According to the second aspect of the present invention, a electronic ballast with high reliability can be provided with an inexpensive structure by detecting the life end stage of a fluorescent lamp with high accuracy even in the vicinity of a lower limit of a dimming control, independently of a dimming control level, and controlling the electronic ballast in a protection mode. Longer life of a fluorescent lamp can also be achieved by supplying an appropriate preheating current.

According to the third aspect of the present invention, a electronic ballast with high reliability can be provided with an inexpensive structure by detecting a life end stage of a fluorescent lamp with high accuracy even in the vicinity of a lower limit of a dimming control, independently of to a dimming control level and controlling the electronic ballast in a protection mode. Predetermined fluorescent lamp power can also be obtained regardless of conditions such as ambient temperatures of a fluorescent lamp by feedback-controlling fluorescent lamp power.

According to the fourth aspect of the present invention, a value of a current flowing into a fluorescent lamp can be limited to a predetermined value or less even at a lamp end of life, thereby allowing protection of circuit components such as a switching element and other elements.

According to the fifth aspect of the present invention, an abnormal lamp discharge state can be easily detected by virtue of a peak value of a current flowing into a fluorescent lamp being detected.

DETAILED DESCRIPTION OF THE INVENTION

Figure 1:
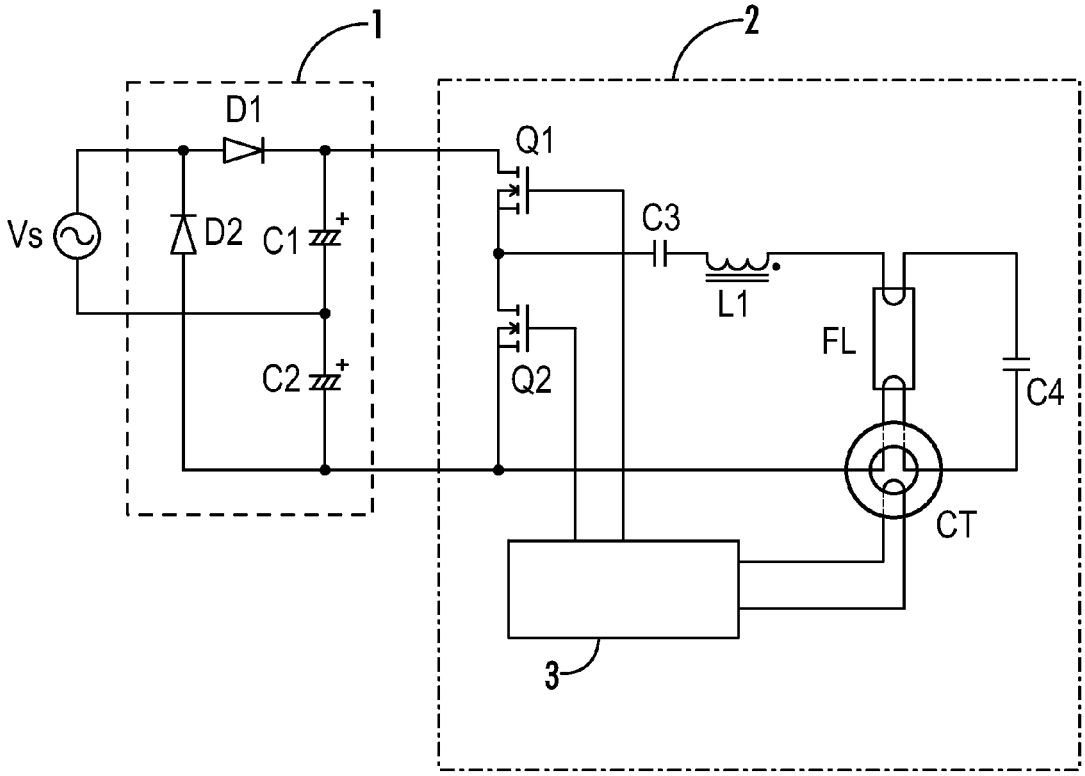
FIG. 1 is a circuit diagram according to a first embodiment of the present invention.

FIG. 1 shows an electronic ballast according to a first embodiment of the present invention. In FIG. 1, reference number 1 refers to a rectifying smoothing circuit, reference no. 2 refers to an inverter circuit, and reference no. 3 refers to an inverter control circuit. The rectifying smoothing circuit 1, which can be a voltage doubler rectifier circuit having rectifier diodes D1 and D2 and smoothing capacitors C1 and C2, outputs a DC voltage by rectifying/smoothing a commercial AC voltage source Vs. The commercial AC voltage source Vs having 100 to 120 V with 50/60 Hz is brought into an output voltage of 140 to 170 V in the rectifying smoothing circuit 1.

The inverter circuit 2 is a half-bridge inverter circuit and includes a series circuit made of switching elements or transistors or MOSFETS Q1 and Q2 connected to an output of the rectifying smoothing circuit 1. The switching elements Q1 and Q2 are turned on/off alternately at high frequencies by a driving signal outputted from the inverter control circuit 3. A fluorescent lamp FL is connected to switching elements Q2 via a capacitor C3 for blocking off DC and an inductor L1 for resonance. The fluorescent lamp FL is a thermionic cathode lamp provided with filament electrodes at both ends of a discharge tube, and a capacitor C4 for resonance is connected in parallel between terminals of the respective electrodes.

An electrode of the fluorescent lamp FL disposed on a low potential side (i.e. ground side) is connected with a current transformer CT so as to detect a lamp current. A lamp current detected by the current transformer CT is inputted to the inverter control circuit 3. The inverter control circuit 3 determines a lamp end of life condition of the fluorescent lamp FL by detection of an excessive peak current in comparison with a normal lighting state, followed by stopping oscillation operation of the switching elements Q1 and Q2.

In the present embodiment, the inverter control circuit 3 changes an oscillation frequency of the inverter circuit 2, thereby changing the light output or illumination level of the fluorescent lamp FL. The lamp output is determined by a voltage outputted from the rectifying smoothing circuit 1 and an operating frequency of the switching elements Q1 and Q2, and changes in accordance with a resonance associated with resonant inductor L1, resonant capacitor C4, and the fluorescent lamp FL.

Figure 2:
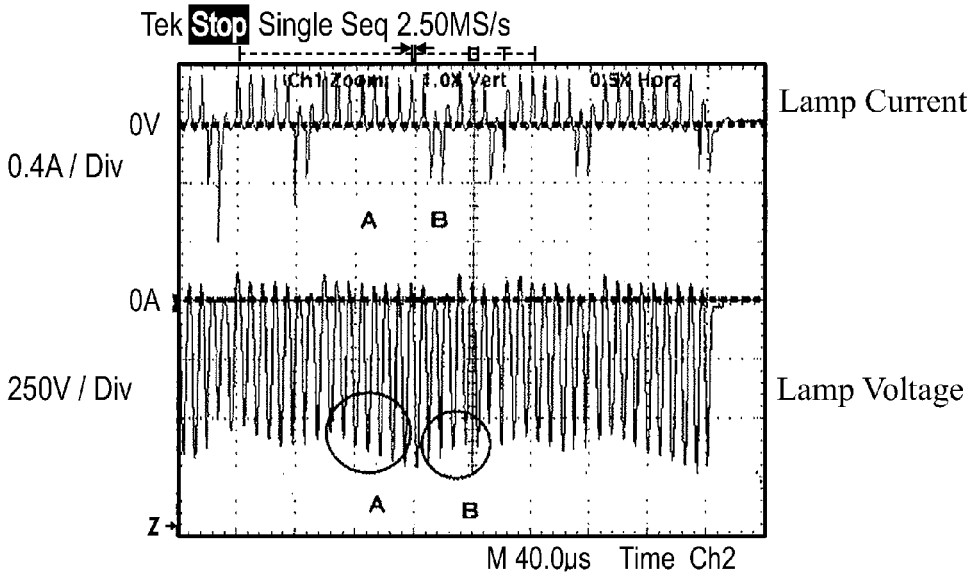
FIG. 2 is a waveform diagram to explain an operation according to the first embodiment of the present invention.
Figure 3:
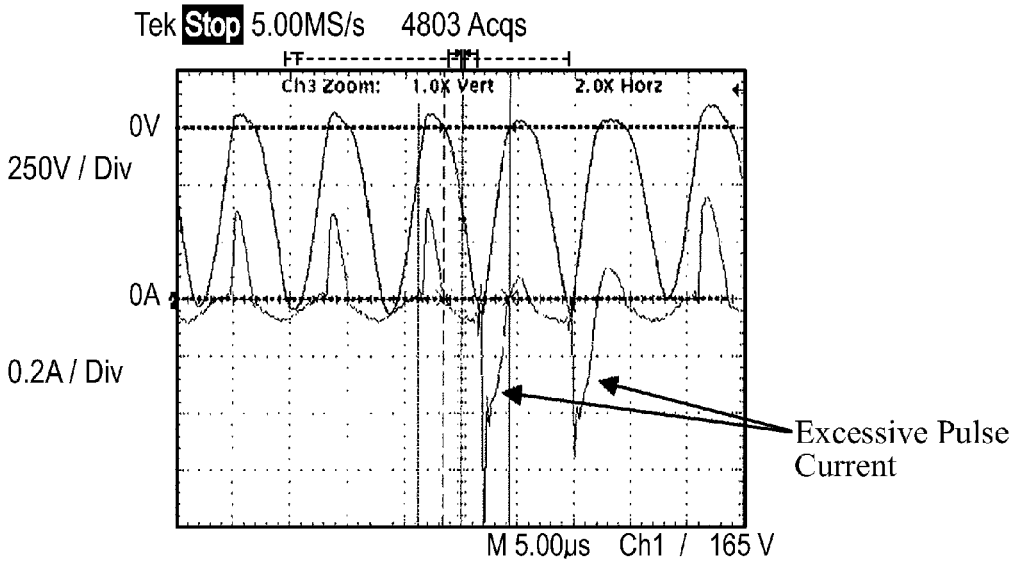
FIG. 3 is a waveform diagram showing an expanded time axis in FIG. 2.
Figure 7:
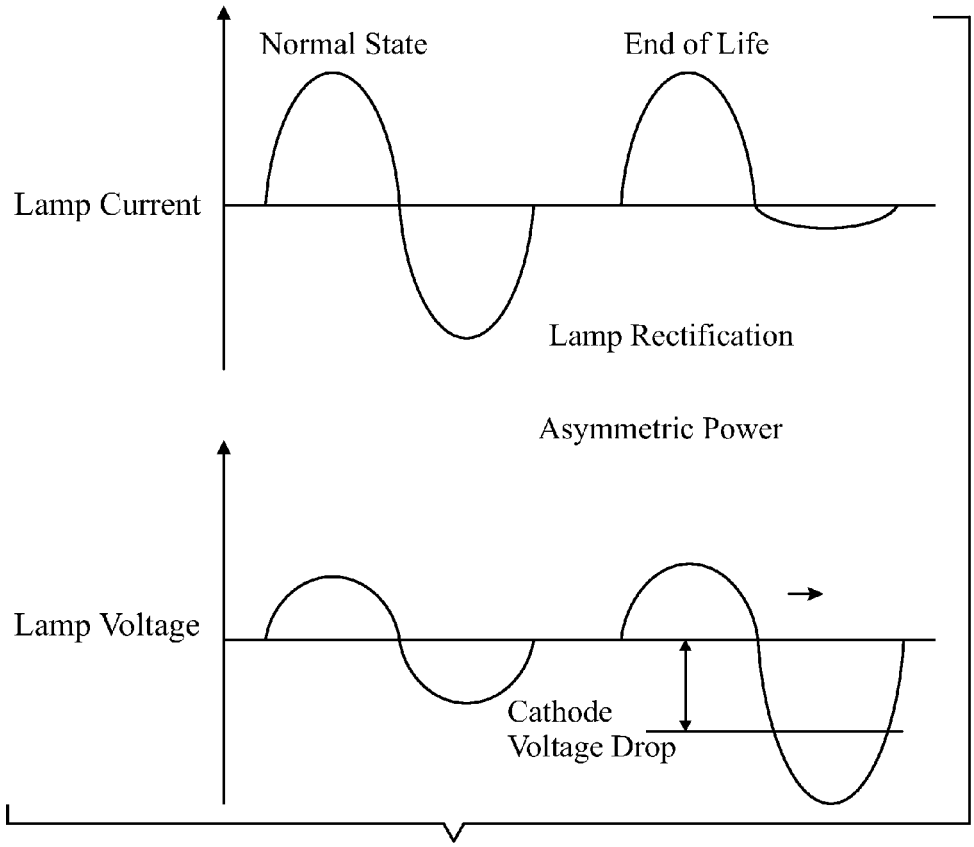
FIG. 7 is a waveform diagram to explain an operation according to the conventional example.

The inverter control circuit 3 uses the current transformer CT to detect a lamp current of the fluorescent lamp FL. At a lamp end of life condition, the fluorescent lamp FL exhibits an asymmetric lamp current as shown in FIG. 7. As a result, a charge current and a discharge current of the resonant capacitor C4 becomes unbalanced, whereby a peak value in one of voltages at both ends of the resonant capacitor C4 is increased as shown by A in FIG. 2. If a peak value on one side of the capacitor C4 exceeds a certain value, an electric charge in this capacitor C4 is discharged via the fluorescent lamp FL as shown by B in FIG. 2. At this point in time, an excessive pulse current occurs in the fluorescent lamp FL as shown in FIG. 3. This excessive pulse current and an excessive power loss due to cathode voltage drop occurring in a cathode which has reached end of life end are generated, whereby overheating can occur in the vicinity of the cathode.

In the present embodiment, an end of life condition of the fluorescent lamp FL is detected by detecting an excessive lamp pulse current using the current transformer CT, and the inverter control circuit 3 stops oscillation of the switching elements Q1 and Q2. Although lamp current in the fluorescent lamp FL decreases during dimming control, lamp end of life can still be determined even in a dimming control by detecting an excessive current pulse, realizing protection of the electronic ballast.

Figure 4:
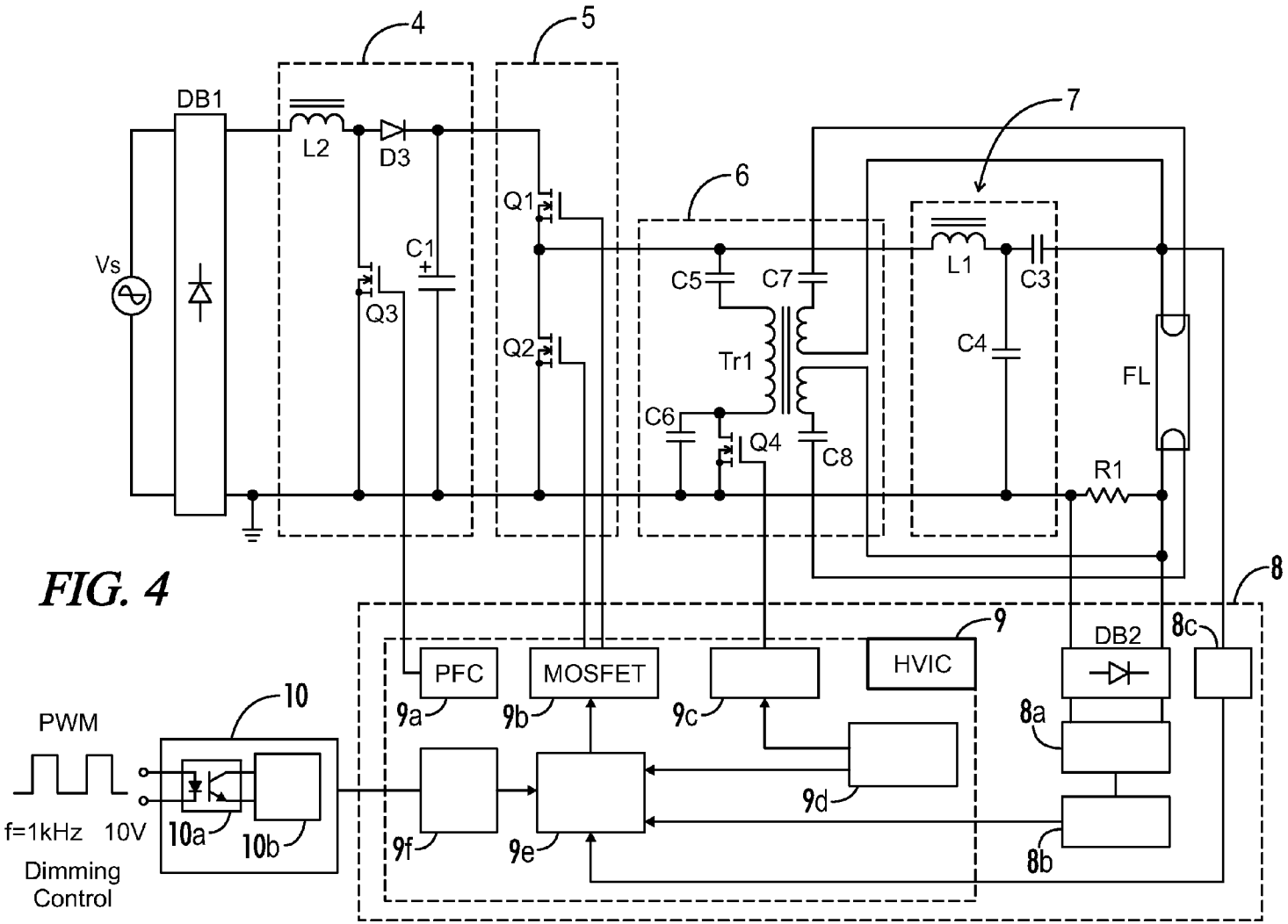
FIG. 4 is a circuit diagram according to a second embodiment of the present invention.

FIG. 4 shows an electronic ballast according to a second embodiment of the present invention. A commercial AC power source Vs is subjected to full-wave rectification by a full-wave rectifier DB1 and converted into a DC voltage by a step-up chopper circuit 4. The step-up chopper circuit 4, which includes an inductor L2, a switching element or transistor or MOSFET Q3, a diode D3 and a smoothing capacitor C1, improves input power factor by turning on/off the switching element Q3 repeatedly at a frequency sufficiently higher than that of the commercial AC power source Vs, and charges the smoothing capacitor C1 with a DC voltage which is boosted to more than a peak value of a voltage outputted from the full-wave rectifier DB1.

A voltage outputted from the step-up chopper circuit 4 is converted into a high-frequency rectangular wave voltage by an inverter circuit 5. The inverter circuit 5 is a half-bridge circuit made of a series circuit including switching elements or transistor or MOSFETs Q1 and Q2, wherein a high-frequency rectangular wave voltage is generated at a connection point between the switching elements Q1 and Q2 by turning on/off the switching elements Q1 and Q2 alternately at high frequencies. The voltage is supplied to a preheating circuit 6 and an LC resonance circuit 7.

The preheating circuit 6 includes a DC blocking capacitor C5, a preheat transformer Tr1, a capacitor C6 serving as a current limiting impedance element for use in constant preheating, a switching element Q4 turned on during preheating, and preheat capacitors C7 and C8. The transformer Tr1 has a primary winding which is connected to an output of the inverter circuit 5 via the DC blocking capacitor C5 and the switching element Q4.

A pair of secondary windings in the preheat transformer Tr1 is connected to filaments in the fluorescent lamp FL via the preheat capacitors C7 and C8 respectively. The switching element Q4 is turned on in preheating in order to supply a sufficient preheating current to the filaments. Although the switching element Q4 is turned off when a preheating period is finished, a high frequency current is made to flow in the primary winding of the preheat transformer Tr1 via the capacitor C6 serving as a current limiting impedance element, whereby a preheating current is constantly supplied to the filaments. A constant preheating current is established to be large enough to be able to maintain a predetermined filament temperature. It is therefore made possible to achieve a longer life of the fluorescent lamp FL.

The LC resonance circuit 7 includes resonant inductor L1 and resonant capacitors C4 and C3, wherein the capacitor C3 is also used as a DC blocking capacitor. A high-frequency rectangular wave voltage outputted from the inverter circuit 5 is converted into a high frequency voltage of a substantially sinusoidal wave by the LC resonance circuit 7 and supplied to the fluorescent lamp FL. Inserted in series between one of the electrodes of the florescent lamp FL and the resonant capacitor C4 is a resistor R1 for current detection. A lamp current is detected by detecting a voltage between both ends of the resistor R1.

Explained next will be a structure of a control circuit 8. The control circuit 8 includes an HVIC 9 which is an integrated circuit having a high breakdown voltage and peripheral circuits thereof. The HVIC 9 includes a preheating control circuit 9*c* for driving the switching element Q4 to be turned on in a preheating period, a PFC control circuit 9*a* for controlling the switching element Q3 in the step-up chopper circuit 4 in order to realize an inputted power factor improving control (i.e. PFC), a MOSFET driver 9*b* for driving the switching elements Q1 and Q2 in the inverter circuit 5, a preheating control circuit 9*c* for controlling the switching element Q4 in the preheating circuit 6, a preheating timer 9*d* for determining a preheating period, an oscillator control circuit 9*e* for controlling an oscillation frequency of the switching elements Q1 and Q2, and a dimming control circuit 9*f* for controlling an operation of the oscillator control circuit 9*e* in response to an external lighting control signal.

In response to an output from the preheating timer 9*d*, the oscillator control circuit 9*e* sets an oscillation frequency of the inverter circuit 5 in a preheating period to be sufficiently higher than a no-load resonance frequency in the LC resonance circuit 7. A resonance voltage is, therefore, set to be lower than a starting voltage in the preheating period and the fluorescent lamp FL is not turned on. At this time, the switching element Q4 of the preheating circuit 6 is turned on and the filaments of the fluorescent lamp FL is sufficiently preheated by an output from the preheating transformer Tr1. At the end of the preheating period, the oscillator control circuit 9*e* decreases an oscillation frequency of the inverter circuit 5 so as to approach a no-load resonance frequency in the LC resonance circuit 7, and the fluorescent lamp FL is turned on when a resonance voltage exceeds a starting voltage of the fluorescent lamp FL. Note that, although the switching element Q4 is turned off after the preheating period and preheating current is cut off, a high frequency current flowing via the capacitor C3 causes a constant preheating current to be supplied to the fluorescent lamp FL.

When the fluorescent lamp FL is turned on, the load impedance of the fluorescent lamp FL is connected in parallel with the LC resonance circuit 7, whereby the Q of the resonance circuit is reduced and the resonance frequency during lamp operation becomes lower than a no-load resonance frequency. In response to an output from the dimming control circuit 9*f*, the oscillation frequency of the inverter circuit 5 is variably controlled in a range higher than the resonance frequency during lighting. The inverter circuit 5 is thus subjected to perform an oscillation operation in a delay mode, with a frequency higher than a resonance frequency during lighting. If the inductive reactance by the inductor L1 is dominant and an oscillation frequency in the inverter circuit 5 is increased, the lamp current is reduced due to increased impedance in the inductor L1.

Explained next will be a structure to realize a dimming control. In the present embodiment, a PWM signal (i.e. on-duty signal) inputted from an external controller is converted into a DC voltage signal via a lighting control signal interface circuit 10 and inputted to the dimming control circuit 9*f* in the HVIC 9, whereby a dimming control for the fluorescent lamp FL is executed in accordance with an on-duty of the PWM signal. The lighting control signal interface circuit 10, which is provided with a opto-coupler 10*a* for isolation and a smoothing circuit 10*b* for smoothing an output from the opto-coupler 10*a*, outputs a DC voltage signal that is increasing/decreasing in accordance with an on-duty cycle of the PWM signal. The dimming control circuit 9*f* in the HVIC 9 realizes a dimming control by variably controlling an oscillation frequency of the inverter circuit 5 in accordance with the DC voltage signal.

A lamp current is converted into a voltage signal by the resistor R1 for current detection. Voltages obtained across resistor R1 are subjected to full-wave rectification by a full-wave rectifier DB2 and a voltage peak value is detected by a peak detecting circuit 8*a*. If a detected voltage peak value is an abnormal value caused by half-wave discharge, an end of life end detection circuit 8*b* determines that the fluorescent lamp FL is at its end of life stage and transmits the detected signal to the oscillator control circuit 9*e* in the HVIC 9. The oscillator control circuit 9*e* stops or reduces an output from the inverter circuit 5 upon receiving a lamp end of life signal.

Note that the oscillator control circuit 9*e* in the HVIC 9 uses a lamp voltage detecting circuit 8*c* to monitor a voltage applied to the fluorescent lamp FL, and also stops or reduces an output from the inverter circuit 5 in the case of having an abnormal rise of a lamp voltage due to a reason other than dimming control.

Figure 5:
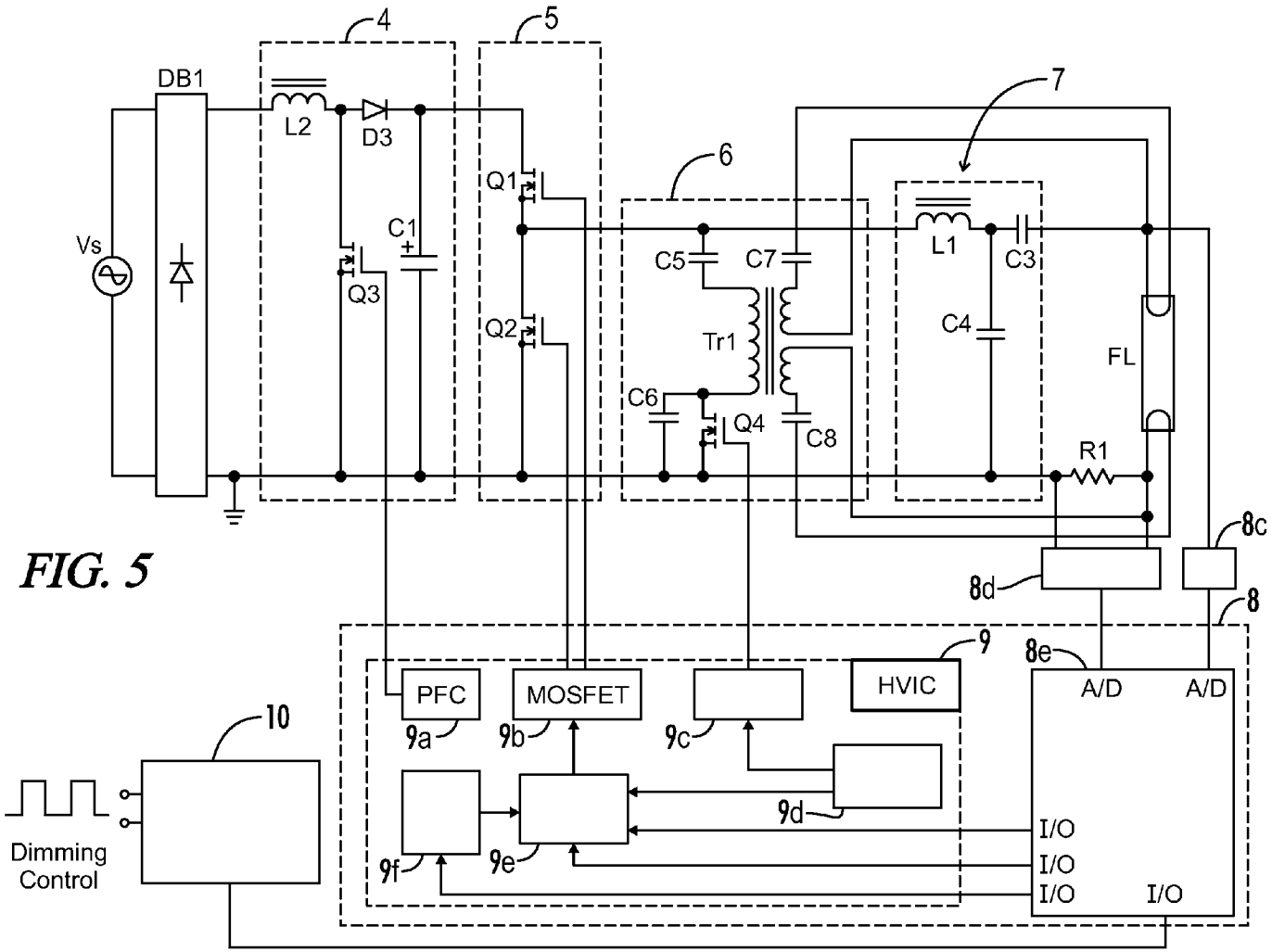
FIG. 5 is a circuit diagram according to a third embodiment of the present invention.
Figure 6:
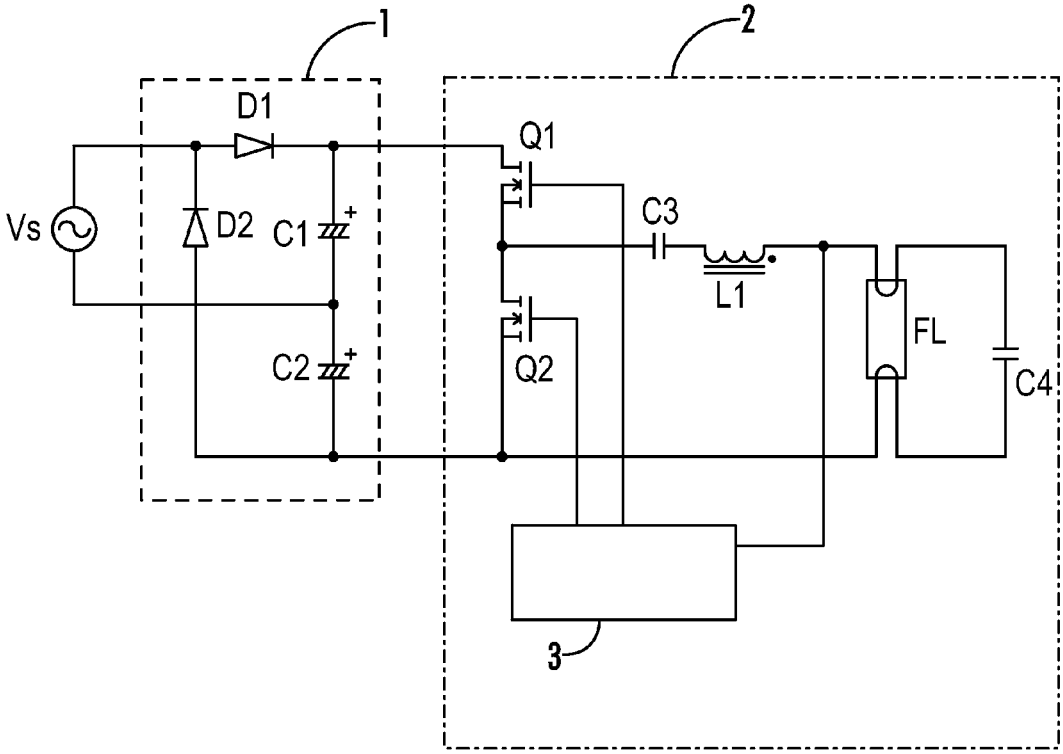
FIG. 6 (PRIOR ART)
FIG. 6 is a circuit diagram according to a conventional example.

FIG. 5 shows an electronic ballast according to a third embodiment of the invention. In the present embodiment, a lighting control signal is a digital signal such as, for example, a DALI signal defined by IEC standard. A digital signal inputted from an external controller is inputted to an I/O port of a microcontroller 8*e* via a lighting control signal interface circuit 10. An oscillator control circuit 9*e* controls an oscillation frequency of switching elements Q1 and Q2 so as to have a predetermined dimming control level via a dimming control circuit 9*f* using the signal which has been subjected to processing in the microcontroller 8*e* and then outputted from an I/O port for dimming control command in the microcontroller 8*e*

In the present embodiment, a lamp current for a fluorescent lamp FL is made to flow in a resistor R1. Therefore, by inputting a voltage across resistor R1 to an A/D conversion input port of the microcontroller 8*e* via a lamp current detecting circuit 8*d*, a lamp current is recognized as a digital signal by the microcontroller 8*e*. Similarly, a lamp voltage for the fluorescent lamp FL is also inputted to an A/D conversion input port of the microcontroller 8*e* via a lamp voltage detecting circuit 8*c*, whereby a lamp voltage is recognized as a digital signal by the microcontroller 8*e*.

If an excessive pulse current occurs at a lamp end of life stage of the fluorescent lamp FL, the microcontroller 8*e* automatically determines a characteristic of a unique waveform as exemplified in FIG. 3, using waveform recognition software. When a characteristic of a waveform unique to lamp end of life stage is detected, oscillation operation of the switching elements Q1 and Q2 is stopped by a signal which is inputted from an I/O port, for outputting a lamp end of life determining signal in the microcontroller 8*e* to the oscillator control circuit 9*e*.

Furthermore, by calculating lamp power using a lamp voltage and a lamp current, each of which was recognized as a digital signal in the microcontroller 8*e*, and returning the lamp power to the oscillator control circuit 9*e*, a feedback control is realized. Predetermined lamp power can be therefore obtained regardless of ambient temperatures of the fluorescent lamp FL or other factors.

Figure 8:
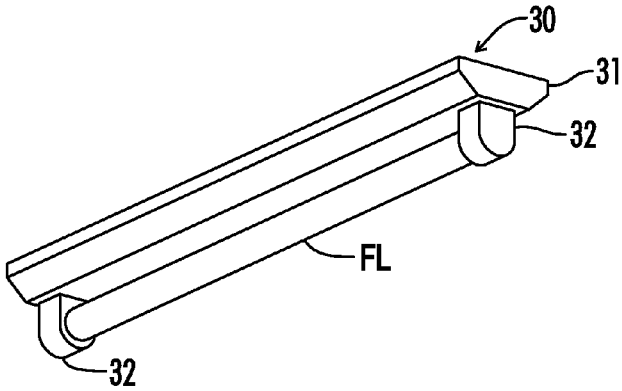
FIG. 8 is a perspective view showing an appearance of a lighting fixture according to a fourth embodiment of the present invention.

FIG. 8 shows a lighting fixture mounted with an electronic ballast according to the first to third embodiments. A lighting fixture 30 has a fixture main body 31 in which the electronic ballast according to any one of the first to third embodiments is integrated, and a pair of sockets 32 for electrically connecting the electronic ballast and a fluorescent lamp FL, wherein each filament electrode of the fluorescent lamp FL is detachably attached to each of the sockets 32. Exemplified here is a straight tube fluorescent lamp as a load, but the present invention may also be applied to lighting devices for circular fluorescent lamps and double-ring fluorescent lamps. A plurality of the lighting fixtures 30 arranged in the same lighting space may also be connected to the same power source system to constitute a lighting system capable of realizing simultaneous lighting by one wall switch or sensor.

Thus, although there have been described particular embodiments of the present invention of a new and useful dimming electronic ballast with lamp end of life detection, it is not intended that such references be construed as limitations upon the scope of this invention except as set forth in the following claims.

What is claimed is:

1. An electronic ballast comprising:

a DC power circuit for generating a DC voltage from an AC power source;

an inverter circuit coupled to the DC power circuit, the inverter circuit operable to convert the DC voltage into a high frequency voltage to supply to a fluorescent lamp, the inverter circuit including an LC series resonance circuit; and a current sensing circuit adapted to detect a current flowing into the fluorescent lamp;

wherein oscillation of the inverter circuit is stopped when a peak value of a current pulse flowing into the fluorescent lamp exceeds a predetermined value.

2. The electronic ballast according to claim 1, further comprising:

a preheating circuit for supplying a preheating current from an output of a secondary winding of a transformer to a cathode of the fluorescent lamp; and means adapted to detect a current flowing into the fluorescent lamp by a voltage between both ends of an impedance element such as a resistor connected between a capacitor for resonance in the LC series resonance circuit and one end of a cathode of the fluorescent lamp.

3. The electronic ballast according to claim 1, comprising means adapted to recognize a current flowing into the fluorescent lamp as a digital signal by using a microcontroller, wherein a life end of the fluorescent lamp is determined by software of the microcontroller.

4. The electronic ballast according to claim 1, wherein a value of a current flowing into the fluorescent lamp is suppressed to a predetermined value or less by controlling an oscillation frequency of the inverter circuit when a value of a current flowing into the fluorescent lamp exceeds a predetermined value.

5. The electronic ballast according to claim 2, wherein the means adapted to detect a current flowing into the fluorescent lamp detects a peak value of a current flowing into the fluorescent lamp.

6. A lighting fixture comprising the electronic ballast according to any one of claims 1 to 5; and a fluorescent lamp coupled to the ballast.

7. An electronic ballast operable to receive power from an alternating current (AC) power source and to provide power to at least one fluorescent lamp, said electronic ballast comprising:

a direct current (DC) power circuit operable to generate a DC voltage from the AC power source;

an inverter circuit coupled to the DC power circuit, wherein the inverter circuit is operable to provide an AC current to the at least one fluorescent lamp from the DC voltage generated by the DC power circuit;

a current sensing circuit operable to detect the AC current flowing through the at least one fluorescent lamp from the inverter circuit, wherein the inverter circuit is connected to the current sensing circuit, and the inverter circuit is operable to detect an end of lamp life condition of the at least one fluorescent lamp and to stop providing the AC current to the at least one fluorescent lamp in response to a peak value of a pulse of the detected AC current exceeding a predetermined value.

8. The electronic ballast of claim 7, wherein the predetermined value is the same with respect to a normal lighting state and a dimmed lighting state.

9. The electronic ballast of claim 7, wherein the current sensing circuit comprises a current transformer.

10. A lighting fixture configured to provide light in response to receiving power from an AC power source, said lighting fixture comprising:

a fluorescent lamp operable to provide light in response to receiving AC power; and an electronic ballast operable to receive power from an alternating current (AC) power source and provide the AC power to the fluorescent lamp, said electronic ballast comprising:

a direct current (DC) power circuit operable to generate a DC voltage from the AC power source;

an inverter circuit coupled to the DC power circuit, wherein the inverter circuit is operable to provide an AC current to the at least one fluorescent lamp from the DC voltage generated by the DC power circuit;

a current sensing circuit operable to detect the AC current flowing through the at least one fluorescent lamp from the inverter circuit, wherein the inverter circuit is connected to the current sensing circuit, and the inverter circuit is operable to detect an end of lamp life condition of the at least one fluorescent lamp and stop providing the AC current to the at least one fluorescent lamp in response to a peak value of a pulse of the detected AC current exceeding a predetermined value.

11. The lighting fixture of claim 10, wherein the predetermined value is the same with respect to a normal lighting state and a dimmed lighting state.

12. The lighting fixture of claim 10, wherein the current sensing circuit comprises a current transformer.

* * * * *